US009988967B2

(12) United States Patent
Prabhakaran et al.

(10) Patent No.: US 9,988,967 B2
(45) Date of Patent: Jun. 5, 2018

(54) COOLING SYSTEM, DEVICE AND METHOD FOR A VEHICLE

(71) Applicant: General Electric Company, Schenectady, NY (US)

(72) Inventors: Manoj Prabhakaran, Bangalore (IN); Jeremy Smith, Grove City, PA (US); Prashanth Madappattil, Thrissur (IN); Arun Shyam Kalleri Karammal, Kannur (IN)

(73) Assignee: General Electric Company, Schenectady, NY (US)

( * ) Notice: Subject to any disclaimer, the term of this patent is extended or adjusted under 35 U.S.C. 154(b) by 303 days.

(21) Appl. No.: 14/598,941

(22) Filed: Jan. 16, 2015

(65) Prior Publication Data

US 2016/0208675 A1 Jul. 21, 2016

(51) Int. Cl.

| | |
|---|---|
| ***F01P 7/04*** | (2006.01) |
| ***F01P 7/16*** | (2006.01) |
| *F01P 7/08* | (2006.01) |
| *F01P 5/04* | (2006.01) |
| *F01P 7/14* | (2006.01) |

(52) U.S. Cl.

CPC ..... *F01P 7/164* (2013.01); *F01P 7/162* (2013.01); *F01P 7/04* (2013.01); *F01P 7/08* (2013.01); *F01P 7/14* (2013.01); *F01P 2005/046* (2013.01)

(58) Field of Classification Search

CPC ..... F01P 7/04; F01P 7/08; F01P 7/14; F01P 2005/046

USPC ..... 123/41.02

See application file for complete search history.

(56) References Cited

U.S. PATENT DOCUMENTS

| | | | | |
|---|---|---|---|---|
| 1,752,230 | A | 3/1930 | Burkhardt | |
| 3,992,894 | A * | 11/1976 | Antonetti | F25D 17/02 137/558 |
| 5,392,741 | A | 2/1995 | Uzkan | |
| 6,230,668 | B1 | 5/2001 | Marsh et al. | |
| 6,499,298 | B2 | 12/2002 | Uzkan | |
| 2003/0065425 | A1 * | 4/2003 | Goodwin | F04D 15/0236 700/282 |
| 2010/0044450 | A1 * | 2/2010 | Roth | F16D 48/06 237/12.3 R |
| 2010/0083916 | A1 * | 4/2010 | Shintani | F01P 7/164 123/41.1 |
| 2010/0116485 | A1 * | 5/2010 | Hiyama | B60H 1/00271 165/202 |
| 2010/0272592 | A1 * | 10/2010 | Chien | F04D 29/046 417/423.7 |

(Continued)

*Primary Examiner* — Jacob Amick
*Assistant Examiner* — Charles Brauch
(74) *Attorney, Agent, or Firm* — GE Global Patent Operation; John A. Kramer

(57) ABSTRACT

A cooling system includes a cooling loop containing a cooling fluid configured for circulation through an engine, an auxiliary alternator configured to be driven by the engine for powering auxiliary loads of the rail vehicle, and a canned pump positioned within the cooling loop and being configured to circulate the cooling fluid through the cooling loop. The canned pump includes an integrated induction motor for driving the pump. The system further includes an electronic control system electrically connected to the auxiliary alternator and configured to electrically power the induction motor of the canned pump independently of a mechanical output of the engine.

14 Claims, 4 Drawing Sheets

(56) References Cited

U.S. PATENT DOCUMENTS

| | | | | |
|---|---|---|---|---|
| 2013/0206357 | A1* | 8/2013 | Chen | F28F 27/00<br>165/11.1 |
| 2013/0291811 | A1* | 11/2013 | Kuhlbach | F02F 1/243<br>123/41.72 |

* cited by examiner

COOLING SYSTEM, DEVICE AND METHOD FOR A VEHICLE

FIELD OF THE INVENTION

Embodiments of the invention relate generally to cooling systems. Other embodiments relate to a cooling system for a rail vehicle or other vehicle.

BACKGROUND OF THE INVENTION

Train locomotives, such as diesel electric locomotives, used to move railway cars along a track are propelled by exerting torque to drive wheels associated with the locomotive that are in contact with rails of the track. The power to propel the locomotive is typically provided first as mechanical energy by a high horsepower diesel engine. The diesel engine drives a generator that converts the mechanical energy to electrical energy. The electrical energy is transferred to traction motors which convert the electrical energy back to mechanical energy in order to drive axles connected to the drive wheels. Friction between the drive wheels of the locomotive and the rails provide the traction for causing movement of the locomotive and the railway cars.

During operation, heat is generated by the engine. In order to prolong the life of the engine and its components, and to maintain efficiency, it is necessary to reduce the temperature of the components to an acceptable level by providing engine cooling. Therefore, all locomotives incorporate a cooling system for cooling the engine and its components.

In a locomotive engine, cooling of the engine components is usually provided by water cooling. The heat generated by the engine is transferred to water circulating through a cooling loop. A water pump provides the water circulation and transfers the heated water from the engine through the cooling loop to a radiator. The radiator typically includes a fan that drives ambient air through the radiator in order to transfer the heat of the water in the water loop to the surrounding air. The cooled water is then circulated to other engine components, such as an oil cooler, and then back to the engine to be reheated. The specific operation, as well as the different systems involved, in the above-described closed loop water cooling system is well known in the art.

Known water pumps for locomotives are typically centrifugal, impeller type water pumps that are mounted on the front-end cover of the engine. Such water pumps have a driving shaft that is operatively coupled to the free end of the crankshaft of the engine and is driven thereby. Traditional mechanically driven water pumps, however, continue to run even under certain conditions such as low load or part load engine conditions. This can lead to slow engine warm up and the degradation of seals due to prolonged operation at idle or lower notches, which ultimately limits water pump and engine life.

It may therefore be desirable to provide a cooling system that is different from existing systems.

BRIEF DESCRIPTION OF THE INVENTION

An embodiment relates to a cooling system comprising a cooling loop, an auxiliary alternator, a canned pump, and an electronic control system. The cooling loop contains a cooling fluid configured for circulation through an engine of a vehicle. The auxiliary alternator is configured to be driven by the engine for powering auxiliary loads of the vehicle. The canned pump is positioned within the cooling loop and is configured to circulate the cooling fluid through the cooling loop. The canned pump comprises an integrated induction motor for driving the pump. The electronic control system is electrically connected to the auxiliary alternator and configured to electrically power the induction motor of the canned pump independently of a mechanical output of the engine.

Another embodiment relates to a method of cooling an engine. The method comprises circulating a cooling fluid through the engine with a canned pump. The canned pump includes an integrated induction motor for driving the pump. The method further comprises powering the induction motor of the canned pump only with electricity from an auxiliary alternator and independently of a mechanical output of the engine, the auxiliary alternator being configured to be driven by the engine.

Another embodiment relates to a method of cooling an engine. The method comprises circulating a cooling fluid through the engine with a canned pump. The canned pump includes an integrated induction motor for driving the pump. The method further comprises powering the induction motor of the canned pump at least partially with electricity from a battery and at least partially with electricity from an auxiliary alternator, the auxiliary alternator being configured to be driven by the engine.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
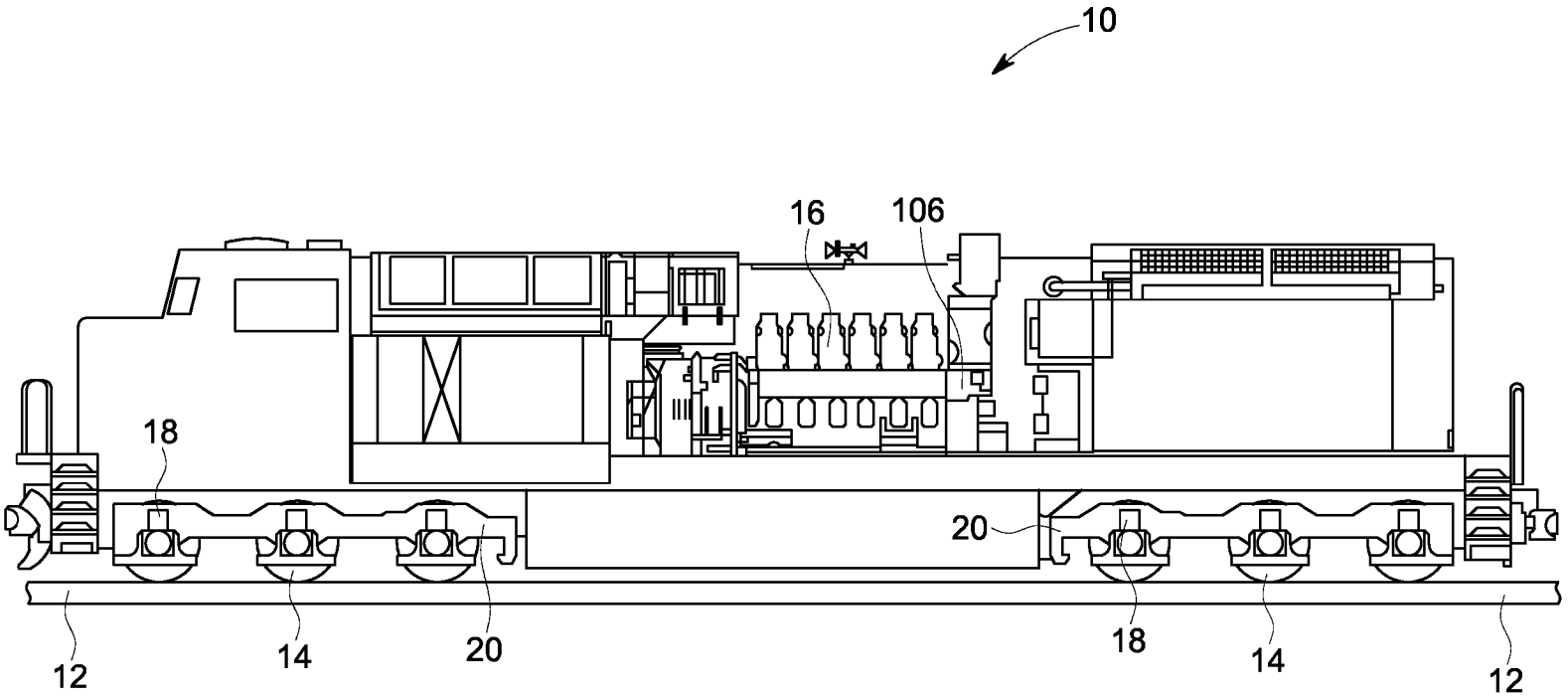
FIG. 1 is a schematic drawing of a vehicle embodying the cooling system and device according to an embodiment of the invention.

Reference will be made below in detail to exemplary embodiments of the invention, examples of which are illustrated in the accompanying drawings. Wherever possible, the same reference numerals used throughout the drawings refer to the same or like parts. Although embodiments are described with respect to rail vehicles and, in particular, locomotives having a diesel engine, embodiments of the invention are also applicable to vehicles generally. In addition, embodiments of the present invention are equally applicable to any type of machinery, motive or non-motive, which includes an internal combustion engine and any other auxiliary components that require the circulation of a cooling fluid for cooling. As used herein, "fluidly coupled" is meant to refer to a coupling through a channel or conduit that allows fluids (e.g., gases and liquids) to flow therethrough or therebetween, at least at desired times. As used herein, "full power notch position" means the position of the throttle that corresponds to the highest speed of the locomotive or other vehicle.

Embodiments of the invention relate to a cooling system and method for a rail vehicle engine, other vehicle engine, or other engine. In the case of a vehicle, the cooling system includes a cooling loop containing a cooling fluid configured for circulation through an engine of the vehicle, an auxiliary alternator driven by the engine, a pump positioned within the cooling loop, the pump being configured to circulate the cooling fluid through the cooling loop, and an electronic control system connected to the alternator and configured to electrically power the pump independently of a mechanical output of the engine. The pump is a canned pump having an integrated induction motor (e.g., integrated squirrel cage induction motor) for driving the pump. As used herein, "canned pump" means a pump with a hermetically sealed motor mounted on a single shaft, and which does not utilize mechanical seals or other sealing devices.

In some embodiments, the cooling system may be configured for use in connection with a vehicle, such as a locomotive or other rail vehicle. For example, FIG. 1 shows a schematic diagram of a vehicle, herein depicted as a locomotive or other rail vehicle 10, configured to run on a rail 12 via a plurality of wheels 14. As depicted, the rail vehicle 10 includes an engine 16, such as an internal combustion engine. A plurality of traction motors 18 are mounted on a truck frame 20, and are each connected to one of the plurality of wheels 14 to provide tractive power to propel and retard the motion of the rail vehicle 10. The traction motors 18 may receive electrical power from a generator to provide tractive power to the rail vehicle 10.

Figure 2:
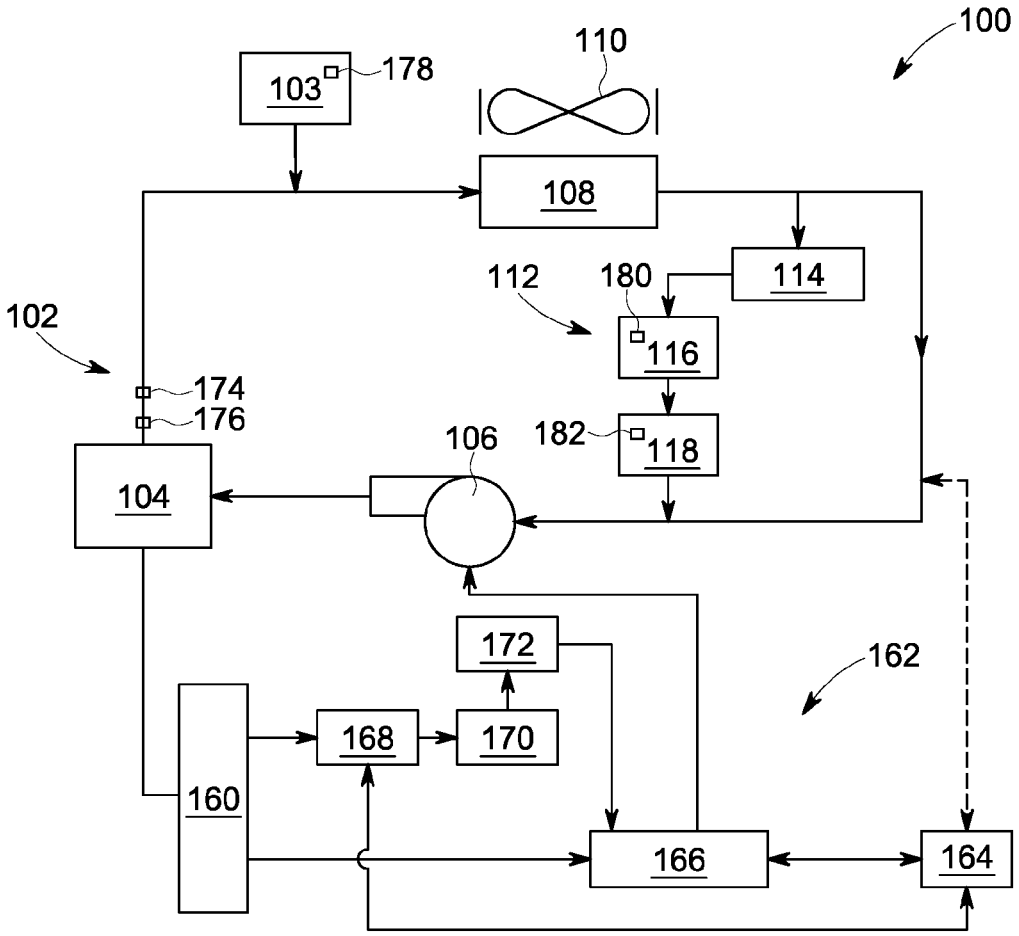
FIG. 2 is a block diagram of an engine cooling system according to an embodiment of the invention.

Turning now to FIG. 2, a schematic diagram of a cooling system 100 for use in the rail vehicle 10 according to an embodiment of the present invention is shown. The cooling system includes a cooling loop 102 containing a cooling fluid. In an embodiment, the cooling fluid is supplied to the cooling loop 102 by a cooling fluid storage reservoir 103. Heat generated by the engine 104 of the rail vehicle is transferred to the cooling fluid circulating through the cooling loop 102. A water pump 106 provides the water circulation and transfers the heated cooling fluid from the engine 104 through the cooling loop 102 to a radiator 108. The radiator includes a fan 110 that drives ambient air through the radiator in order to transfer the heat of the cooling fluid in the cooling loop 102 to the surrounding air. The cooled cooling fluid is then circulated to other engine components and then back to the engine to be reheated. In an embodiment, the cooling fluid is water, although cooling fluids of other compositions known in the art may also be utilized without departing from the broader aspects of the present invention. In an embodiment, the cooling fluid is water containing one or more additives such as glycol.

In an embodiment, as illustrated in FIG. 2, the cooling loop 102 may include a sub-cooling loop 112 that includes one or more subcoolers, an oil cooler 116, and an intercooler 118. In an embodiment, the oil cooler 116 is a brazed plate oil cooler. As discussed in detail below, in embodiments having a sub-cooling loop, a portion of the total flow of cooling fluid enters the sub-cooling loop for further cooling before recombining with the remaining cooling fluid that did not enter the sub-loop 112 and entering the engine 104. The fan 110 and shutters (not shown) regulate air flow to the radiator and/or subcoolers 114.

Figure 3:
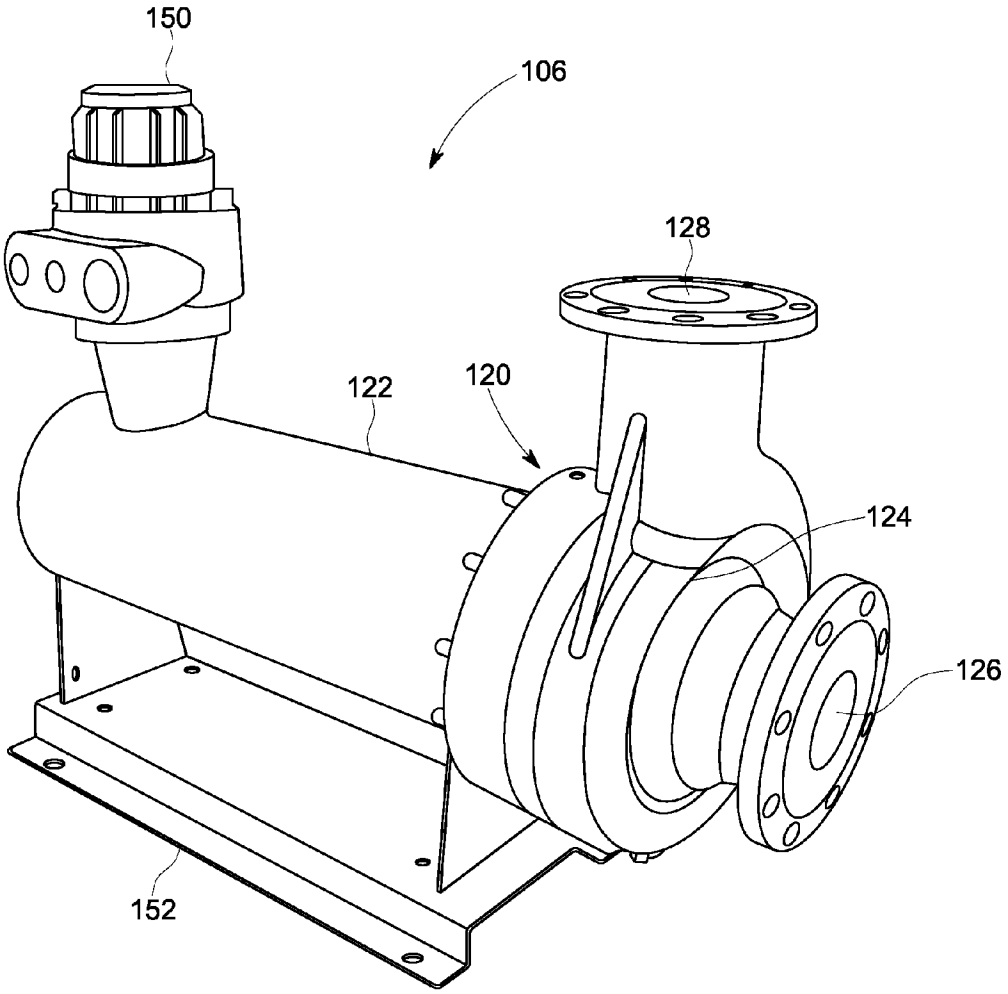
FIG. 3 is a perspective view of an exemplary water pump for use with the engine cooling system of FIG. 2, according to an embodiment of the invention.
Figure 4:
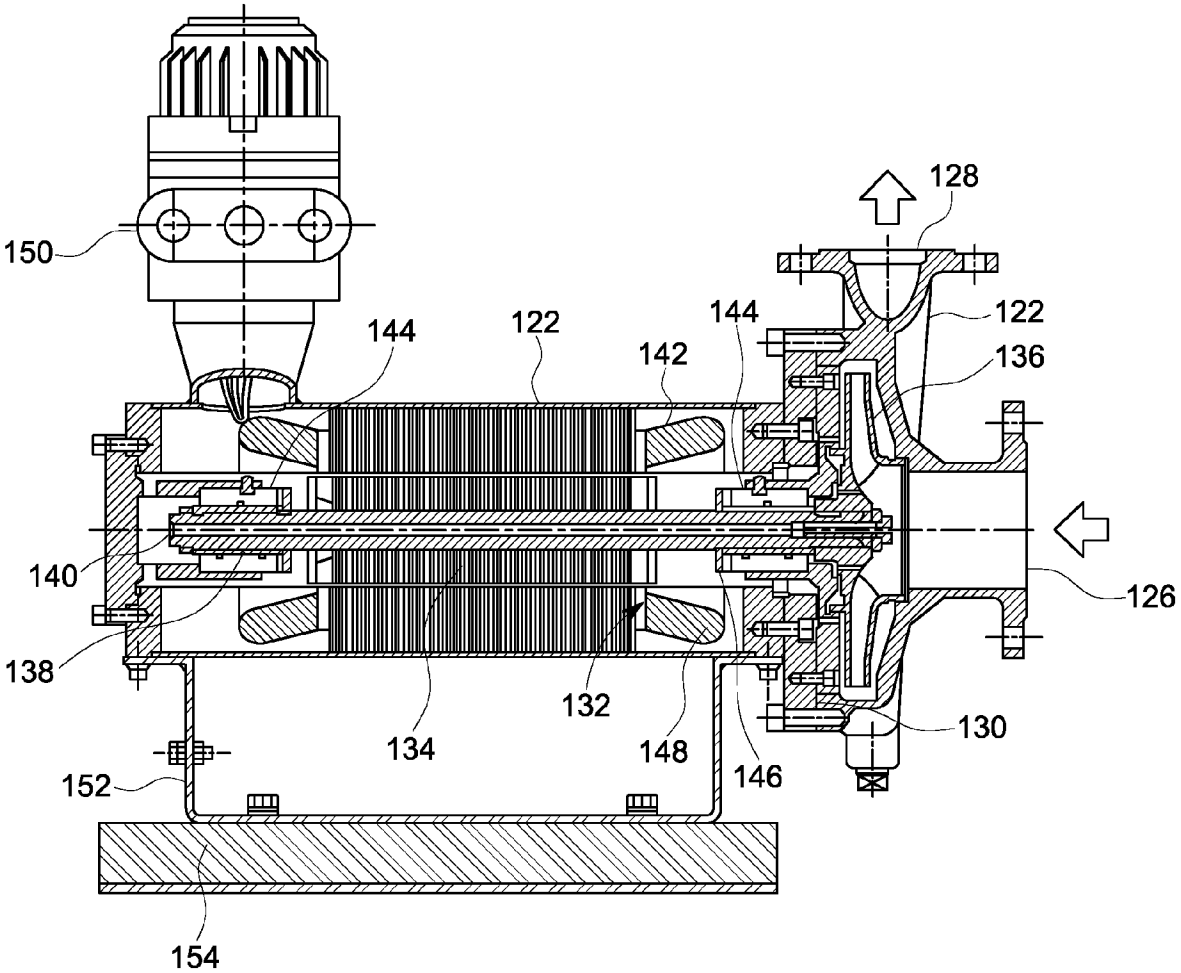
FIG. 4 is a cross-sectional view of the water pump of FIG. 3.

With reference to FIGS. 3 and 4, in an embodiment, the water pump 106 is a canned pump driven by an induction motor. As shown therein, pump 106 includes a housing or casing 120 having a shaft housing 122 and a volute 124 coupled to the shaft housing 122. The volute 124 includes an inlet 126 and an outlet 128. As shown in FIGS. 3 and 4, the inlet 126 and outlet 128 are oriented at approximately 90 degrees with respect to one another, although other orientations are certainly possible without departing from the broader aspects of the present invention. A casing gasket 130 is positioned between the volute 124 and body portion 122, and the volute 124 is coupled to the housing 122 via bolts.

The inlet 126 of the water pump 106 is fluidly coupled to the outlet of the radiator 108 of the cooling system 100, and is configured to receive cooled cooling fluid from the radiator 108, while the outlet 128 of the water pump 106 is fluidly coupled to the cooling loop inlet of the engine 104, and is configured to pump cooled cooling fluid through the engine 104 to cool the engine and its components.

As alluded to above, and as best shown in FIG. 4, within the housing 122 of the casing 120 is a squirrel cage induction motor 132 having a combined rotor/impeller assembly including a rotor 134 and impeller 136 carried on a shaft sleeve 138 surrounding a shaft 140. The induction motor 132 further includes a stator winding 142 surrounding the rotor 134. The shaft sleeve 138 and shaft 140 are carried on and supported by bearings 144 at opposed ends of the shaft 140. In an embodiment, the bearings may be silicone carbine bearings that provide corrosion resistance and which contain self-aligning features that prevent point contact between the rotating and stationary components.

As best shown in FIG. 4, the water pump 106 also includes a thrust washer 146 surrounding the shaft 140 adjacent to the impeller 136. In connection with this, the water pump 106, in an embodiment, employs automatic thrust balancing which serves to balance the thrust along the range from a shut-off condition to a fully open condition.

As further shown in FIGS. 3 and 4, the water pump 106 includes a terminal box 150 containing terminals for electrically connecting the water pump 106 to an electronic control system configured to control operation of the pump 106 in dependence upon a variety of parameters and per specific engine cooling requirements, as discussed hereinafter.

In an embodiment, the water pump 106 includes a mounting bracket 152 that allows the water pump 106 to be mounted to a platform of the locomotive or other mounting surface via bolts or other fasteners. As such, this simple, in-line mounting of the water pump 106 requires no special foundation or bedplate, which decreases installation costs.

In an embodiment, the water pump is configured to operate in variable voltage and variable frequency to provide pressurized cooling fluid to the engine at rated flow, temperature and pressure for the engine.

In an embodiment, during operation, a portion of the pumped cooling fluid is permitted to recirculate through the rotor cavity to cool the induction motor 132 and lubricate the bearings 144 and to provide motor cooling. As will be readily appreciated, by utilizing the cooling fluid itself as a lubricant, there is no need to employ separate lubricating systems or external lubrication, as has customarily been the case.

As best shown in FIG. 4, the pump 106 also includes thermal wiring protection in the form of a corrosion resistant, non-magnetic alloy liner 148 surrounding the stator winding 142 that seals or "cans" the stator winding 142. This functions, in part, to protect the rotor armature from contact with the recirculating cooling fluid.

As will be readily appreciated, the "canned" nature of the water pump 106 of the present invention substantially obviates the possibility of leakage and reduces noise. As discussed above, the water pump 106 is driven by an internally-housed induction motor 132, not by the crankshaft of the engine of the locomotive. Accordingly, the pump is therefore not subject to direct engine vibrations which can potentially damage the pump, causing seal degradation and ultimately leakage. Indeed, as there is no mechanical seal present whatsoever, which is required in engine-driven water pumps, downtime and maintenance costs resulting from the replacement of seals or servicing of the water pump due to leakage is substantially reduced, and the service life of the water pump is thereby increased.

Referring back to FIG. 2, the cooling system 100 also includes an auxiliary alternator 160 driven by the engine 104. In an embodiment, the auxiliary alternator 160 is utilized to power auxiliary loads of the rail vehicle, such as the pump 106, as discussed in detail hereinafter. As used herein, "auxiliary loads" means loads other than traction motors for moving the rail vehicle. As shown therein, the cooling system 100 further includes an electronic control system 162 electrically connected to the auxiliary alternator 160 and the pump 106 and configured to electrically power the induction motor of the pump 106 independently of the mechanical output of the engine 104.

With specific reference to the lower portion of FIG. 2, the electronic control system 162 includes a control unit 164 and a contactor 166 electrically connected to the auxiliary alternator 160, the pump 106, and the control unit 164, and being controllable via the control unit 164. In an embodiment, the electronic control system 162 also includes a rectifier 168 electrically connected to the auxiliary alternator 160 and the control unit 164, a battery 170 electrically connected to the rectifier 168, and an inverter 172 electrically connected to the battery 170 and the contactor 166.

In an embodiment, the electronic control system 162 is in communication with a plurality of sensors within the cooling loop 102 that relay various cooling loop parameters to the control unit 164. For example, an engine water temperature sensor 174 may monitor the cooling fluid temperature within the cooling loop 102 at the outlet of the engine 104 and provide temperature feedback to the control unit 164. In addition, an engine water pressure sensor 176 may monitor the pressure of the cooling fluid within the cooling loop 102 at the outlet of the engine and provide pressure feedback to the control unit 164. Other sensors such as a coolant level sensor 178, lubrication oil temperature sensor 180 and mass air flow temperature sensor 182, may monitor other cooling loop parameters and relay signals relating to these parameters to the control unit 164 so that a desired level of cooling can be achieved through operation of the canned pump 106, as discussed in detail below. In particular, as discussed hereinafter, the electronic control system 162, through the control unit 164, is configured to control operation of the canned pump 106 in dependence upon feedback from the cooling fluid temperature, cooling fluid pressure, cooling fluid level, lubrication oil, and mass air flow temperature sensors within the cooling loop 102.

As discussed above, the pump 106, under the control and direction of the electronic control system 162, circulates the cooling fluid within the cooling loop 102. As the cooling fluid exits the engine, it passes through one or more radiators, such as radiator 108, where heat from the cooling fluid is dissipated to atmosphere via fan 110. As shown in FIG. 2, in an embodiment, a portion of the total flow in the cooling loop 102, after entering radiator 108, enters sub-cooling loop 112 for further cooling. Here, the cooling fluid within loop 112 is further cooled in sub-coolers 114 (where removed heat is dissipated to atmosphere via a fan, e.g., fan 108), whereafter the cooling fluid is directed to the oil cooler 116. The cooling fluid then flows to an intercooler, such as charge air intercooler 118. The fluid passing through the intercooler 118 then recombines with the remainder of the fluid that did not enter the sub-cooling loop 112 adjacent to the suction side of the canned pump 106, as illustrated in FIG. 2. As will be readily appreciated, operation of the canned pump 106, in either the first mode of operation or in the second mode of operation, is controlled by the electronic control system 162 in dependence upon feedback from the engine water temperature sensor 174.

In an embodiment, in a "first mode of operation," also referred to as normal or default operation, electronic control system 162 is configured to electrically power the induction motor of the pump 106 with electricity from the auxiliary alternator 160. In this mode of operation, the control unit 164 is configured to switch the pump 106 on or off, as needed. As the pump 106 operates on variable voltage and variable frequency, it is capable of providing flow rates as per the engine notch requirements in this first mode of operation.

In an embodiment, in the first mode of operation, the electronic control system 162 is configured to control operation of the pump 106 in dependence upon feedback from the pressure sensor 176. For example, if feedback from the water pressure sensor 176 indicates that the cooling loop 102 is running low on cooling fluid, the control unit 164 may switch off the pump 106. In particular, if the detected water pressure within the cooling loop 102 is above a predetermined lower threshold, the contactor 166 is closed by the control unit 164, which transitions the motor of the canned pump 106 to its on (activated) state. If the pressure detected by sensor 176 is less than the threshold pressure, the contractor 166 is opened, which transitions the motor of the canned pump 106 to its off (deactivated) state.

In another embodiment, the electronic control system 162 is configured to control operation of the pump 106 in dependence upon feedback from the coolant level sensor 178. In particular, when the monitored coolant level within the coolant reservoir 103 is above a predetermined lower threshold amount, the contactor 166 is in its closed state and the motor of the pump is on. If the coolant level within the reservoir 103 drops below the preset lower threshold, the contactor 166 is transitioned to its open state by the control unit 164, thereby deactivating the pump 106.

In a "second mode of operation," also referred to as a tunneling mode, the electronic control system 162 is configured to electrically power the induction motor of the pump 106 at least partially with electricity provided by the battery 170, with the remainder of the electricity being provided by the auxiliary alternator 160. In particular, the control unit 164 is configured to control operation of the pump 106 through the contactor 166. In this mode of operation, even when the rail vehicle 10 is de-rated, the pump 106 may run at full speed and provide a fixed, higher flow rates for a limited, predetermined time interval under control of the control unit 164 of the electronic control system 162. As will be readily appreciated, operation at higher flow rates relative to the notch position of the vehicle 10 enhances engine and turbocharger cooling and, in particular, lowers the lubrication oil temperature and improves the fluid films for all bearings and contacts. In an embodiment, the electronic control system 162 is configured to permit operation in the second mode for a maximum of 15 minutes. In other embodiments, the control system 162 may be configured to permit operation in the second mode of operation for 15 minutes, or approximately 15 minutes (from 14 to 16 minutes), or for greater or less than 15 minutes.

In an embodiment, in the second mode of operation, the electronic control system 162 is configured to control operation of the pump 106 in dependence upon feedback from the pressure sensor 176. In particular, if the detected water pressure within the cooling loop 102 is above a predetermined lower threshold, the contactor 166 is closed by the control unit 164, which transitions the motor of the canned pump 106 to its on (active) state, similar to the first mode of operation, as discussed above. If the pressure detected by sensor 176 is less than the threshold pressure, the contractor 166 is opened, which transitions the motor of the canned pump 106 to its off (deactivated) state.

Also similar to the manner of operation described above in connection with the first mode of operation, in another embodiment, the electronic control system 162 is configured to control operation of the pump 106 in dependence upon feedback from the coolant level sensor 178 in the second mode of operation. In particular, when the monitored coolant level within the coolant reservoir 103 is above a predetermined lower threshold amount, the contactor 166 is in its closed state and the motor of the pump is on. If the coolant level within the reservoir 103 drops below the preset lower threshold, the contactor 166 is transitioned to its open state by the control unit 164, thereby deactivating the pump 106.

In another embodiment, in the second mode of operation, the electronic control system 162 is configured to control operation of the pump 106 in dependence upon feedback from the cooling fluid temperature sensor 174 and cooling fluid pressure sensor 176. In particular, if the detected temperature of the cooling fluid exceeds a predetermined maximum temperature value for normal operation, additional cooling is required. Accordingly, if the detected pressure within the cooling loop 102 is above a predetermined lower threshold, indicating healthy operation, and the rail vehicle is running between idle and full power, the contactor 166 is closed by the control unit 164, which activates the motor of the canned pump 106. In such a case, where the detected temperature exceeds a predetermined level, and it is determined from the pressure sensor 176 that the cooling system health is sufficient to provide additional cooling, the control unit 164 controls operation of the pump 106 to provide maximum flow, regardless of the notch position of the rail vehicle.

As will be readily appreciated, the system 100 of the present invention provides better controllability of the pump 106 at each notch position of the rail vehicle as compared to existing cooling systems. In particular, the electronic control system 162 is configured to selectively initiate and maintain operation of the pump 106 to provide standard cooling or additional cooling, and to stop operation of the pump 106 if cooling fluid level or pressure is not sufficient to provide for adequate cooling. The system 100 also allows for rapid ramp-ups in cooling fluid flow to stabilize the temperature of the engine and other components at start up. Additionally, by providing the ability to set the water pump 106 at a desired fixed flow, rather than a reduced flow corresponding to a particular notch position, the temperature of the lubrication oil can be reduced quickly and efficiently.

As will be readily appreciated, as the pump 106 operates independently from the mechanical output of the engine 104, the pump 106 may be selectively switched off when there is a low amount of cooling fluid (or no cooling fluid) within the system 10, and when the locomotive is idling or during cold starts, which results in significant power savings. Such functionality has heretofore not been possible with existing engine-driven locomotive water pumps, which are directly tied to the operation of the engine. This ability to selectively switch the pump 106 on or off also helps meet emissions standards.

In connection with the above, because the pump 106 is not driven directly by the engine 104, the pump does not contain any rotating or static seals (which would be necessary if the pump were coupled to the engine), which obviates the possibility of seal degradation and failure due to engine vibrations. In addition, because the pump 106 is not coupled to the engine, the weight on the engine is reduced.

In addition to the above described technical advantages, the cooling system 100 of the present invention also provides a number of commercial advantages such as low maintenance and overhaul costs and the elimination of the need for external lubrication of the pump (required for engine-drive pumps). Moreover, minimum spare parts and moving parts are required as compared to engine-driven water pumps, which in combination with the increased reliability leads to material savings.

An embodiment of the present invention relates to a cooling system. The cooling system includes a cooling loop containing a cooling fluid configured for circulation through an engine of a vehicle, an auxiliary alternator configured to be driven by the engine for powering auxiliary loads of the vehicle, a canned pump positioned within the cooling loop and being configured to circulate the cooling fluid through the cooling loop, wherein the canned pump comprises an integrated induction motor for driving the pump, and an electronic control system electrically connected to the auxiliary alternator and configured to electrically power the induction motor of the canned pump independently of a mechanical output of the engine.

In an embodiment, the electronic control system is configured to electrically power the canned pump at a variable voltage and a variable frequency to provide the cooling fluid at a rated flow, temperature, and pressure to the engine. In an embodiment, the electronic control system is configured to deactivate the canned pump when cooling is not required or when a dry operating condition is sensed.

In an embodiment, the electronic control system is configured to electrically power the induction motor of the canned pump only with electricity from the auxiliary alternator in a first mode of operation, and to electrically power the induction motor of the canned pump at least partially with electricity from a battery in a different, second mode of operation.

In an embodiment, the electronic control system, in the first and second mode of operation, is configured to control operation of the canned pump in dependence upon a detected pressure of the cooling fluid within the cooling loop. In particular, the electronic control system is configured to control the canned pump to an ON state if the detected pressure is above a predetermined threshold pressure and to deactivate the canned pump if the detected pressure is below the threshold pressure.

In an embodiment, the electronic control system, in the first and second mode of operation, is configured to control operation of the canned pump in dependence upon a level of the cooling fluid within the cooling loop. In particular, the electronic control system is configured to control the canned pump to an ON state if the level is above a predetermined threshold level and to deactivate the canned pump if the level is below the threshold level In an embodiment, the electronic control system, in the first mode of operation, is configured to control operation of the canned pump to provide a flow rate of the cooling fluid corresponding to a notch position of the rail vehicle and, in the second mode of operation, is configured to control operation of the canned pump to provide a flow rate of the cooling fluid corresponding to a full power notch position of the rail vehicle when the rail vehicle is operating at a notch position less than the full power notch position.

In an embodiment, the cooling system further includes a temperature sensor positioned along the cooling loop and being configured to detect a temperature of the cooling fluid within the cooling loop, and a pressure sensor positioned along the cooling loop and being configured to detect a pressure of the cooling fluid within the cooling loop. In the second mode of operation, the electronic control system is configured to control operation of the canned pump in dependence upon feedback from the temperature sensor and the pressure sensor. In an embodiment, the electronic control system is configured to control the canned pump to provide a fixed, higher flow rate relative to a notch position of the vehicle for a predetermined interval of time if the temperature of the cooling fluid is above a predetermined maximum temperature, the pressure of the cooling fluid is above a predetermined lower threshold pressure, and the rail vehicle is operating at a notch position between idle and full power. In an embodiment, the predetermined interval of time may be approximately 15 minutes.

In another embodiment, a method of cooling an engine is provided. The method includes circulating a cooling fluid through the engine of the rail vehicle with a canned pump, the canned pump including an integrated induction motor for driving the pump, and powering the induction motor of the canned pump only with electricity from an auxiliary alternator and independently of a mechanical output of the engine. The auxiliary alternator is configured to be driven by the engine.

In an embodiment, the step of powering the induction motor of the canned pump includes electrically powering the canned pump at a variable voltage and a variable frequency to provide the cooling fluid at a rated flow, temperature, and pressure to the engine.

In an embodiment, the method includes the step of controlling operation of the canned pump in dependence upon a detected pressure of the cooling fluid, including activating the canned pump if the detected pressure is above a predetermined threshold pressure and deactivating the canned pump if the detected pressure is below the threshold pressure.

In an embodiment, the method includes the step of controlling operation of the canned pump in dependence upon a level of the cooling fluid within a cooling loop, including activating the canned pump if the level is above a predetermined threshold level and deactivating the canned pump if the level is below the threshold level.

In another embodiment, a method of cooling an engine is provided. The method includes circulating a cooling fluid through the engine with a canned pump, the canned pump including an integrated induction motor for driving the pump, and powering the induction motor of the canned pump at least partially with electricity from a battery and at least partially with electricity from an auxiliary alternator. The auxiliary alternator is configured to be driven by the engine.

In an embodiment, the method includes the step of controlling operation of the canned pump in dependence upon a detected pressure of the cooling fluid, including activating the canned pump if the detected pressure is above a predetermined threshold pressure and deactivating the canned pump if the detected pressure is below the threshold pressure.

In an embodiment, the method includes the step of controlling operation of the canned pump in dependence upon a level of the cooling fluid within a cooling loop, including activating the canned pump if the level is above a predetermined threshold level and deactivating the canned pump if the level is below the threshold level.

In an embodiment, the method includes the step of controlling operation of the canned pump to provide a flow rate of the cooling fluid corresponding to a full power notch position of the rail vehicle when the rail vehicle is operating at a notch position less than the full power notch position.

In an embodiment, the method includes the steps of detecting a temperature of the cooling fluid, detecting a pressure of the cooling fluid, and controlling the canned pump to provide a fixed, higher flow rate relative to a notch position of the rail vehicle for a predetermined interval of time if the temperature of the cooling fluid is above a predetermined maximum temperature, the pressure of the cooling fluid is above a predetermined lower threshold pressure, and the rail vehicle is operating at a notch position between idle and full power. The predetermined interval of time may be approximately 15 minutes.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the cooling system, device and method without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A cooling system, comprising:

a cooling loop containing a cooling fluid configured for circulation through an engine of a vehicle;

an auxiliary alternator configured to be driven by the engine for powering auxiliary loads of the vehicle;

a canned pump positioned within the cooling loop and being configured to circulate the cooling fluid through the cooling loop, wherein the canned pump comprises an integrated induction motor for driving the pump; and an electronic control system electrically connected to the auxiliary alternator and configured to electrically power the induction motor of the canned pump independently of a mechanical output of the engine;

wherein the electronic control system is configured to electrically power the induction motor of the canned pump only with electricity from the auxiliary alternator in a first mode of operation, and to electrically power the induction motor of the canned pump at least partially with electricity from a battery in a second mode of operation.

2. The cooling system of claim 1, wherein:

the electronic control system is configured to electrically power the canned pump at a variable voltage and a variable frequency to provide the cooling fluid at a rated flow, temperature, and pressure to the engine.

3. The cooling system of claim 1, wherein:

the electronic control system is configured to deactivate the canned pump when cooling is not required, and the electronic control system is configured to deactivate the canned pump when a dry operating condition is sensed.

4. The cooling system of claim 1, wherein:

the electronic control system, in the first and second modes of operation, is configured to control operation of the canned pump in dependence upon a detected pressure of the cooling fluid within the cooling loop; and the electronic control system is configured to control the canned pump to an on state if the detected pressure is above a predetermined threshold pressure and to deactivate the canned pump if the detected pressure is below the threshold pressure.

5. The cooling system of claim 1, wherein:

the electronic control system, in the first and second modes of operation, is configured to control operation of the canned pump in dependence upon a level of the cooling fluid within the cooling loop; and the electronic control system is configured to control the canned pump to an on state if the cooling fluid level is above a predetermined threshold level and to deactivate the canned pump if the cooling fluid level is below the threshold level.

6. The cooling system of claim 1, wherein:

the electronic control system, in the first mode of operation, is configured to control operation of the canned pump to provide a flow rate of the cooling fluid corresponding to a throttle position of the vehicle; and the electronic control system, in the second mode of operation, is configured to control operation of the canned pump to provide a flow rate of the cooling fluid corresponding to a full throttle position of the vehicle when the vehicle is operating with the throttle position at less than the full throttle position.

7. The cooling system of claim 1, further comprising:

a temperature sensor positioned along the cooling loop, the temperature sensor being configured to detect a temperature of the cooling fluid within the cooling loop; and a pressure sensor positioned along the cooling loop, the pressure sensor being configured to detect a pressure of the cooling fluid within the cooling loop;

wherein the electronic control system, in the second mode of operation, is configured to control operation of the canned pump based at least in part on the temperature and the pressure that are detected.

8. A cooling system, comprising:

a cooling loop containing a cooling fluid configured for circulation through an engine of a vehicle;

an auxiliary alternator configured to be driven by the engine for powering auxiliary loads of the vehicle;

a canned pump positioned within the cooling loop and being configured to circulate the cooling fluid through the cooling loop, wherein the canned pump comprises an integrated induction motor for driving the pump;

an electronic control system electrically connected to the auxiliary alternator and configured to electrically power the induction motor of the canned pump independently of a mechanical output of the engine, wherein the electronic control system is configured to electrically power the induction motor of the canned pump only with electricity from the auxiliary alternator in a first mode of operation, and to electrically power the induction motor of the canned pump at least partially with electricity from a battery in a second mode of operation;

a temperature sensor positioned along the cooling loop, the temperature sensor being configured to detect a temperature of the cooling fluid within the cooling loop; and a pressure sensor positioned along the cooling loop, the pressure sensor being configured to detect a pressure of the cooling fluid within the cooling loop;

wherein the electronic control system, in the second mode of operation, is configured to control operation of the canned pump based at least in part on the temperature and the pressure that are detected;

and wherein the electronic control system is configured to control the canned pump to provide a fixed, higher flow rate relative to a throttle position of the vehicle for a predetermined interval of time if the temperature of the cooling fluid is above a predetermined maximum temperature, the pressure of the cooling fluid is above a predetermined lower threshold pressure, and the vehicle is operating with the throttle position between idle and full power.

9. The cooling system of claim 8, wherein:

the electronic control system is configured to electrically power the canned pump at a variable voltage and a variable frequency to provide the cooling fluid at a rated flow, temperature, and pressure to the engine.

10. The cooling system of claim 8, wherein:

the electronic control system is configured to deactivate the canned pump when cooling is not required, and the electronic control system is configured to deactivate the canned pump when a dry operating condition is sensed.

11. The cooling system of claim 8, wherein:

the electronic control system, in the first and second modes of operation, is configured to control operation of the canned pump in dependence upon a detected pressure of the cooling fluid within the cooling loop; and the electronic control system is configured to control the canned pump to an on state if the detected pressure is above a predetermined threshold pressure and to deactivate the canned pump if the detected pressure is below the threshold pressure.

12. The cooling system of claim 8, wherein:

the electronic control system, in the first and second modes of operation, is configured to control operation of the canned pump in dependence upon a level of the cooling fluid within the cooling loop; and the electronic control system is configured to control the canned pump to an on state if the cooling fluid level is above a predetermined threshold level and to deactivate the canned pump if the cooling fluid level is below the threshold level.

13. The cooling system of claim 8, wherein:

the electronic control system, in the first mode of operation, is configured to control operation of the canned pump to provide a flow rate of the cooling fluid corresponding to a throttle position of the vehicle; and the electronic control system, in the second mode of operation, is configured to control operation of the canned pump to provide a flow rate of the cooling fluid corresponding to a full throttle position of the vehicle when the vehicle is operating with the throttle position at less than the full throttle position.

14. The cooling system of claim 8, wherein:

the predetermined interval of time is approximately 15 minutes.

* * * * *